US007037178B2

(12) United States Patent
Cron

(10) Patent No.: US 7,037,178 B2
(45) Date of Patent: May 2, 2006

(54) METHODS FOR CONDITIONING SURFACES OF POLISHING PADS AFTER CHEMICAL-MECHANICAL POLISHING

(75) Inventor: Brian E. Cron, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/705,371

(22) Filed: Nov. 10, 2003

(65) Prior Publication Data

US 2004/0097176 A1 May 20, 2004

Related U.S. Application Data

(62) Division of application No. 10/075,172, filed on Feb. 13, 2002.

(51) Int. Cl.
*B24B 53/00* (2006.01)

(52) U.S. Cl. ..... 451/56; 451/21; 451/285; 451/443

(58) Field of Classification Search ..... 451/21, 451/41, 52, 56, 57, 285–288, 443, 444
See application file for complete search history.

(56) References Cited

U.S. PATENT DOCUMENTS 5,616,069 A 4/1997 Walker et al.
5,779,522 A 7/1998 Walker et al.
6,012,968 A 1/2000 Lofaro
6,217,422 B1 4/2001 Franca et al.
6,224,461 B1 5/2001 Boehm, Jr. et al.
6,332,835 B1 12/2001 Nishimura et al.
6,439,968 B1 8/2002 Obeng
6,443,816 B1 * 9/2002 Inoue et al. ..... 451/56
6,533,647 B1 3/2003 Brunelli
6,589,878 B1 * 7/2003 Lorimer ..... 438/704
6,740,247 B1 5/2004 Han et al.
6,776,691 B1 8/2004 Nishimura et al.
2003/0217762 A1 11/2003 Kobayashi et al.

* cited by examiner

*Primary Examiner*—Lee D. Wilson
*Assistant Examiner*—Anthony Ojini
(74) *Attorney, Agent, or Firm*—Wells St. John P.S.

(57) ABSTRACT

The invention includes a method for conditioning a surface of a polishing pad after chemical-mechanical polishing of a semiconductor substrate with the pad surface. The method includes exposing the pad surface to steam, and the steam can comprise ammonium citrate. The invention also includes an apparatus for conditioning a surface of a polishing pad after chemical-mechanical polishing of a semiconductor substrate with the pad surface. The apparatus includes a conditioning stone, and a steam outlet port proximate the conditioning stone. The steam outlet port is configured to jet steam onto the pad surface during the conditioning of the pad surface.

17 Claims, 5 Drawing Sheets

SWEEP MOTOR
32
30
20
28
26
24
18
25
14
22

METHODS FOR CONDITIONING SURFACES OF POLISHING PADS AFTER CHEMICAL-MECHANICAL POLISHING

RELATED PATENT DATA

This patent resulted from a divisional application of U.S. patent application Ser. No. 10/075,172, which was filed Feb. 13, 2002.

TECHNICAL FIELD

The invention pertains to methods for conditioning surfaces of polishing pads after chemical-mechanical polishing, and further pertains to apparatuses for conditioning surfaces of polishing pads after chemical-mechanical polishing.

BACKGROUND OF THE INVENTION

Chemical-mechanical polishing is a process utilized for removing materials during semiconductor device fabrication. A prior art method of chemical-mechanical polishing is described diagrammatically with reference to FIG. 1. Specifically, FIG. 1 illustrates a construction 10 comprising a semiconductor substrate 12, and a polishing pad 14 provided over substrate 12. Semiconductor substrate 12 can comprise, for example, monocrystalline silicon having one or more layers of insulative and/or conductive materials provided thereover. To aid in interpretation of the claims that follow, the terms "semiconductive substrate" and "semiconductor substrate" are defined to mean any construction comprising semiconductive material, including, but not limited to, bulk semiconductive materials such as a semiconductive wafer (either alone or in assemblies comprising other materials thereon), and semiconductive material layers (either alone or in assemblies comprising other materials). The term "substrate" refers to any supporting structure, including, but not limited to, the semiconductive substrates described above.

Substrate 12 can comprise a conductive layer comprising, consisting essentially of, or consisting of, copper (not shown) at an upper surface, and the polishing operation shown in FIG. 1 can be utilized to planarize such copper-containing material. Polishing pad 14 will typically comprise a porous polyurethane material. A slurry 15 is provided at an interface between pad 14 and substrate 12. Slurry 15 comprises particulates (such as, for example, silicon dioxide and/or aluminum oxide particles) in a liquid medium. The liquid can comprise, for example, water.

In operation, pad 14 is displaced relative to substrate 12, with such displacement indicated by arrow 16. It is to be understood that pad 14 can be displaced in a linear relation relative to substrate 12 (as indicated by arrow 16) and/or in a rotational relation relative to substrate 12. Also, it is to be understood that pad 14 can, in exemplary applications, be a round pad associated with a rotating platen in particular apparatuses, or can be a non-round pad associated with a web of material moved relative to substrate 12 in other apparatuses (with such other apparatusses frequently being referred to as web chemical-mechanical polishing tools). Also, it is to be understood that the displacement of pad 14 relative to substrate 12 can occur by movement of one or both of pad 14 and substrate 12.

Displacement of pad 14 relative to substrate 12 causes abrasion of the upper surface of substrate 12 with the material of slurry 15. Such abrasion polishes (typically planarizes) an upper surface of substrate 12. More specifically, pad 14 comprises a polishing surface 18 which contacts slurry 15 and causes abrasion of an upper surface of substrate 12 with slurry 15.

After polishing of the upper surface of substrate 12, the substrate is removed from proximate pad 14, and surface 18 is reconditioned. The reconditioning removes liquid and particles associated with slurry 15 from within pores of pad 14. The reconditioning can also remove material displaced from the surface of substrate 12 that has lodged within the pores of polishing surface 18 of pad 14.

The reconditioning of pad 14 typically comprises displacing polishing surface 18 across a conditioning stone to rub undesired materials from over surface 18, and thereby expose a new, clean polishing surface. A typical conditioning stone will be a diamond-impregnated material, with the diamond particles being very coarse (typically, from about 100 microns to about 200 microns in average cross-sectional size). Diamond is utilized because of its superior wear characteristics relative to other materials.

An exemplary prior art conditioning apparatus is described with reference to FIGS. 2 and 3. FIG. 2 illustrates a side-view of a conditioning apparatus 20, and FIG. 3 illustrates a front-view of the apparatus. Apparatus 20 comprises a pad holder 22 having a polishing pad 14 retained therein. The polishing surface 18 of pad 14 is exposed. Apparatus 20 further comprises a conditioning stone 24 retained within a conditioning stone holder 26. The conditioning stone holder is mounted in a motor/gimbal which is configured to displace stone 24 relative to pad 14. The displacement can be along a linear or rotating direction. Motor/gimbal assembly 28 is connected through an arm 30 to a motor 32. Various gears and belts (not shown) can extend from motor 32 through arm 30 to motor 28, and accordingly can drive motor/gimbal 28 to accomplish displacement of stone 24 relative to pad 14.

In operation, stone 24 has a surface 25 which contacts polishing surface 18, and abrades surface 18 to remove contaminants from the surface. The removal of the contaminants ultimately exposes a clean surface of pad 14. Typically, stone 24 removes a portion of pad 14 associated with surface 18 to remove contaminants and expose a fresh polishing surface of the pad.

Various difficulties can occur during the reconditioning of polishing pads with conditioning stones. For instance, some contaminants can be difficult to remove from a polishing pad during reconditioning, with particular difficult contaminants including metals, such as, for example, copper. Accordingly, it would be desirable to develop improved methods for reconditioning polishing pads.

SUMMARY OF THE INVENTION

In one aspect, the invention encompasses a method for conditioning a surface of a polishing pad after chemical-mechanical polishing of a semiconductor substrate with the pad surface. The method includes exposing the pad surface to steam. In particular aspects, the steam can comprise ammonium citrate.

In another aspect, the invention encompasses an apparatus for conditioning a surface of a polishing pad after chemical-mechanical polishing of a semiconductor substrate with the pad surface. The apparatus includes a conditioning stone, and a steam outlet port proximate the conditioning stone. The steam outlet port is configured to jet steam onto the pad surface during the conditioning of the pad surface.

BRIEF DESCRIPTION OF THE DRAWINGS

Preferred embodiments of the invention are described below with reference to the following accompanying drawings.

FIG. 6 is a diagrammatic front view of a second embodiment apparatus that can be utilized in various aspects of the present invention.

DETAILED DESCRIPTION OF THE PREFERRED EMBODIMENTS

Figure 1:
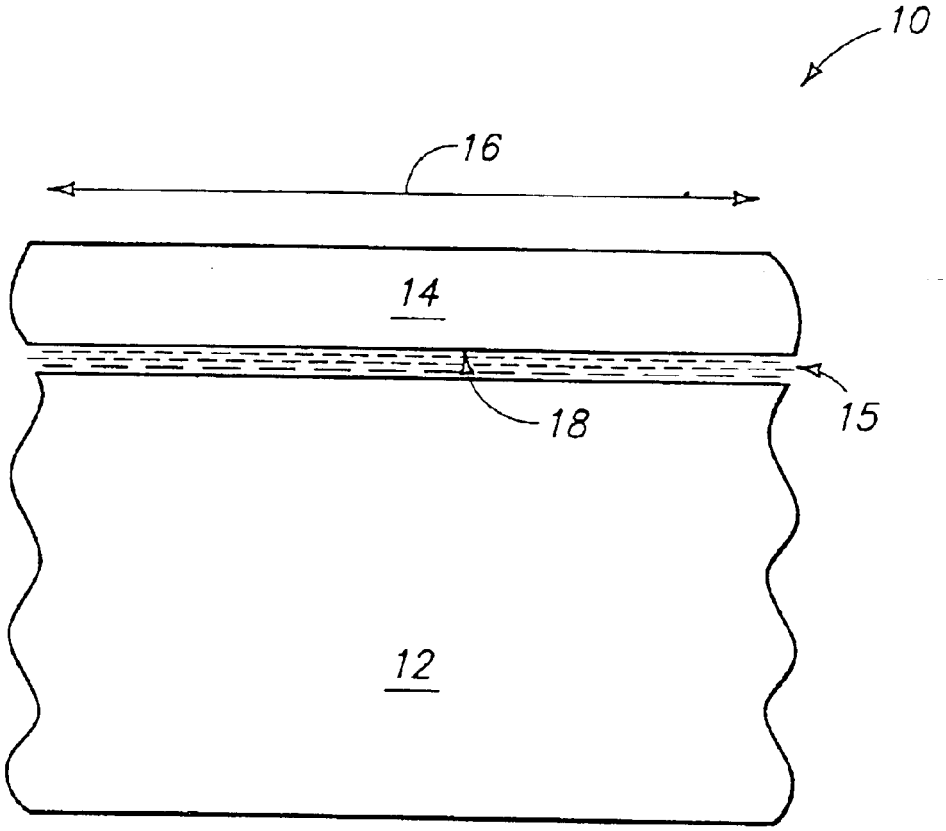
FIG 1 PRIOR ART
FIG. 1 is a diagrammatic, cross-sectional view of a polishing pad juxtaposed relative to a semiconductor wafer during a prior art polishing operation.
Figures 2, 3:
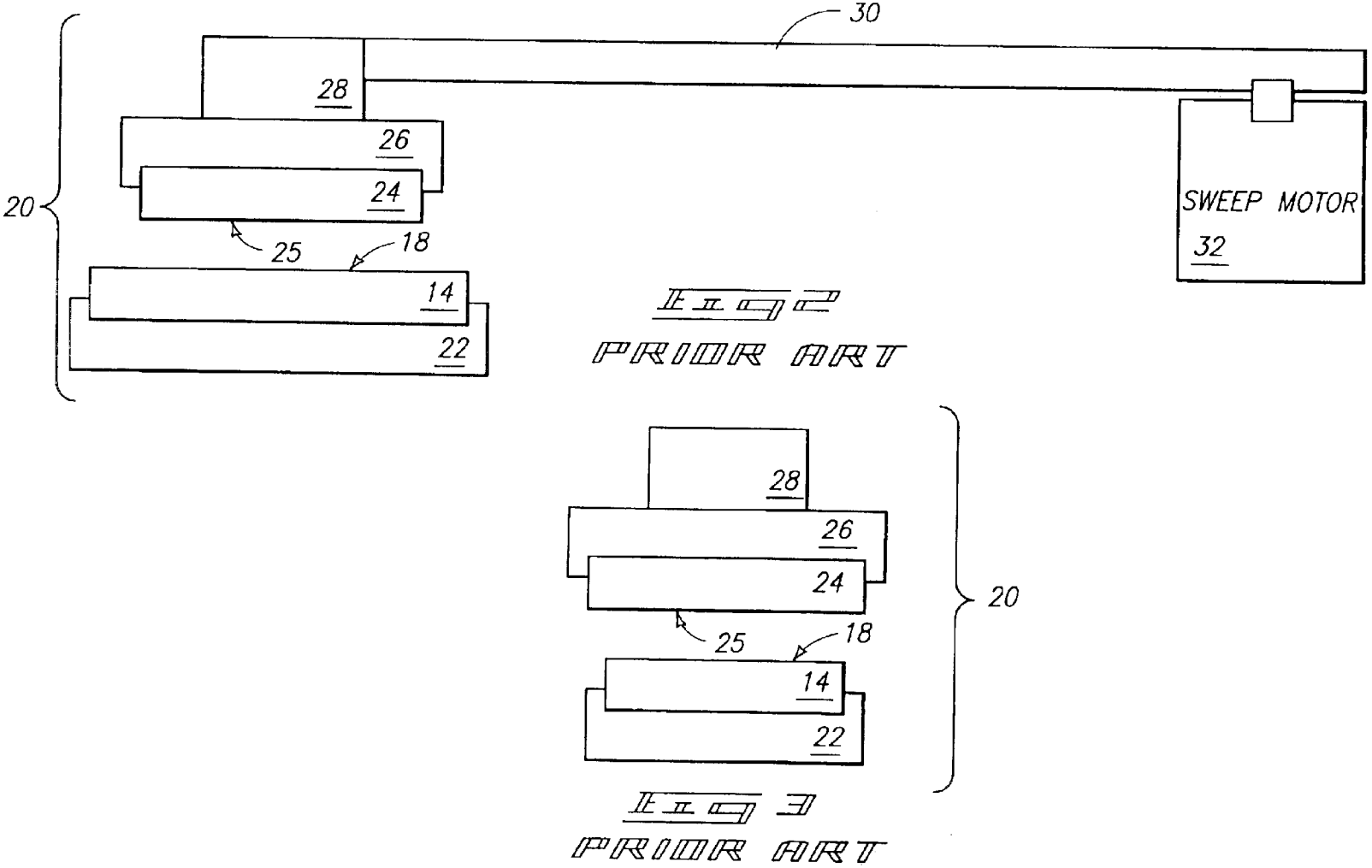
FIG. 2 PRIOR ART
FIG. 3 PRIOR ART
FIG. 2 is a diagrammatic side view of a prior art apparatus utilized for reconditioning a polishing pad.
FIG. 3 is a diagrammatic front view of the FIG. 2 apparatus.
Figure 4:
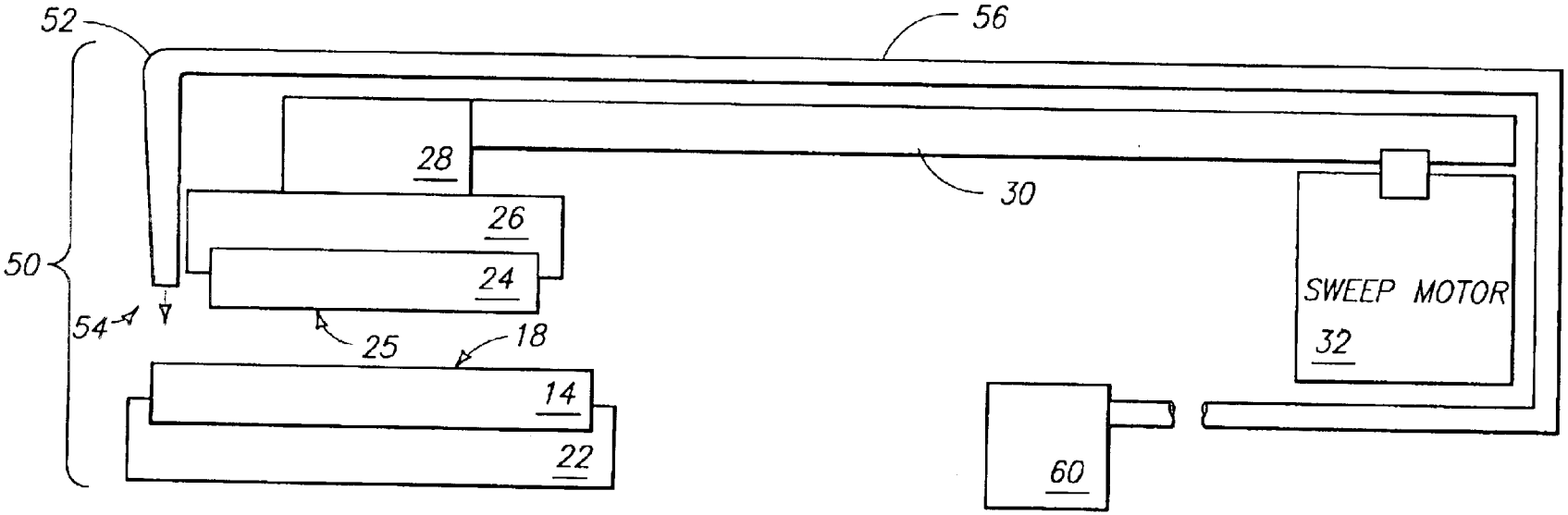
FIG. 4 is a diagrammatic side view of a polishing pad reconditioning apparatus constructed in accordance with an embodiment of the present invention.

FIG. 4 is a diagrammatic view of an apparatus 50 which can be utilized in according to methodology of the present invention for reconditioning a polishing pad. In referring to FIG. 4, similar numbering will be utilized as was used above in describing the prior art structures of FIGS. 1–3, where appropriate.

Apparatus 50 comprises a polishing pad holder 22 which retains a polishing pad 14 having a polishing pad surface 18 which is to be reconditioned. Apparatus 50 further comprises a conditioning stone 24, retained within a conditioning stone holder 26. Stone holder 26 is mounted to a motor/gimbal apparatus 28. Motor/gimbal apparatus 28 is joined through a conditioning arm 30 to a motor 32. The structures 14, 22, 24, 26, 28, 30 and 32 can be identical to those structures described above having the same numbers in the prior art apparatuses of FIGS. 2 and 3. Apparatus 50 differs from the prior art in having a steam conditioning head 52 mounted relative to conditioning stone holder 26 through mounting structures (not shown). Steam conditioning head 52 comprises an end which terminates in a port 54.

Steam conditioning head 52 is mounted to a conduit 56 which is in fluid communication with a steam source 60. Source 60 can comprise, for example, a steam generator; and the steam can be generated from, for example, deionized water.

In operation, steam is transferred from source 60 through conduit 56 and into conditioning head 52. The steam then jets out of head 52 (indicated by downwardly extending arrows exiting from port 54) and impacts polishing surface 18. The exposure of surface 18 to the steam can force contaminants out of pores associated with surface 18, and can thereby assist in cleaning surface 18. Further, steam 60 can have cleaning agents provided therein which assist in removing contaminating materials from polishing surface 18. For instance, if a contaminating material comprises copper, or other metals, various metal-solubilizing agents can be included within the steam. An exemplary solubilizing agent for solubilizing copper is ammonium, and such agent can be provided within the steam as, for example, ammonium citrate. In embodiments in which ammonium citrate is provided within the steam, the concentration of ammonium citrate can be, for example, from about 3% to about 10% (by volume).

The steam preferably impacts surface 18 with a pressure from about 10 psig (pounds per square inch gauge) to about 20 psig, which can effectively displace particulates from within pores associated with surface 18. The steam preferably has a temperature of at least about 200° F. at a pressure of at least about 10 psig, and preferably has a temperature of from about 200° F. to about 300° F. as it exits port 54. The heated steam can beneficially reduce a temperature range of a thermal-cycle that pad 14 is exposed to in going from polishing operations to reconditioning operations. Specifically, pad 14 will typically be heated by friction during a polishing operation, and it can be advantageous to keep pad 14 relatively heated during a reconditioning operation to avoid thermal stresses which could otherwise contribute to wear of the pad.

Figure 5:
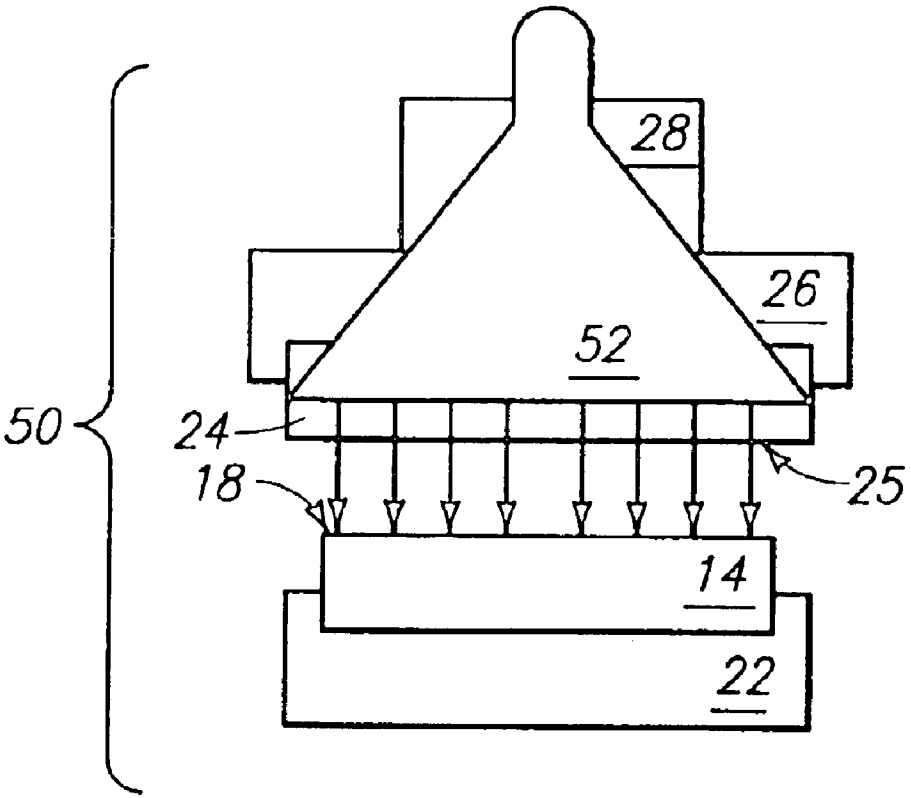
FIG. 5 is a diagrammatic front view of the FIG. 4 apparatus.
Figure 11:
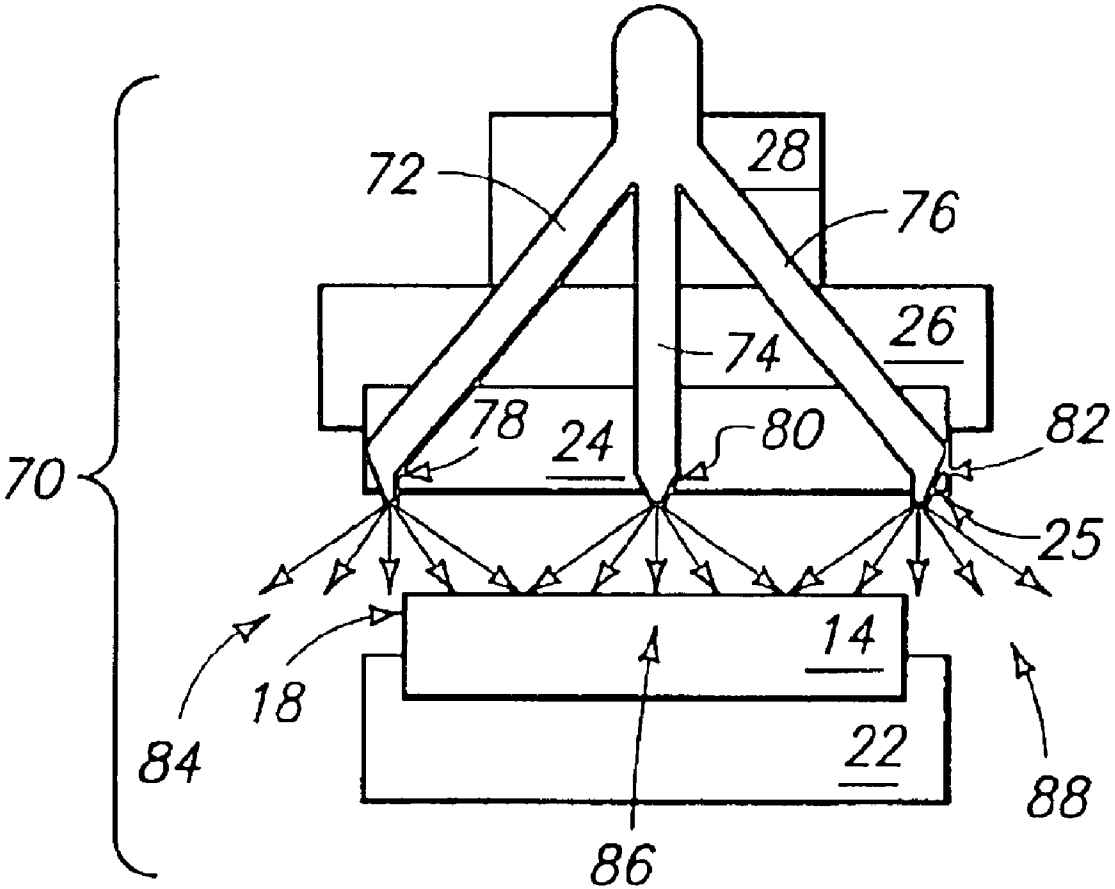

FIG. 5 shows a front view of a portion of apparatus 50, and illustrates an exemplary shape of conditioning head 52. FIG. 5 also illustrates steam exiting from head 52 (downwardly extending arrows) and impacting surface 18 of pad 14.

In the shown embodiment, head 52 covers only a portion of pad 14, and head 52 is preferably displaced relative to pad 14 during a cleaning operation so that an entirety of surface 18 is exposed to steam. It is to be understood, however, that the invention encompasses other embodiments (not shown) wherein head 52 is configured to be large enough to have a port 54 which entirely covers surface 18 of pad 14. Accordingly, the entire surface of pad 18 can be exposed to steam without displacing head 52 relative to the pad. The displacement of head 52 relative to pad 14 can comprise movement of either head 52 (while holding pad 14 stationery); pad 14 (while holding head 52 stationery); or both pad 14 and head 52.

In the shown embodiment, the displacement of head 52 relative to pad 14 preferably also displaces surface 18 relative to stone 24 to cause stone 24 to rub against surface 18 to further recondition the surface. Surface 18 is shown separated from stone 24 by a space for illustrative purposes. It is to be understood, however, that in actual operation surface 18 would preferably contact a conditioning surface 25 of stone 24 during a reconditioning operation.

The polishing pad 14 cleaned by methodology of the present invention can comprise any suitable geometry; including round and non-round geometries. Regardless of the geometry, pad 14 is preferably exposed to a pressurized spray of steam during cleaning of the pad.

Although the shown embodiment exposes polishing surface 18 to a conditioning stone during the cleaning of surface 18 with steam, it is to be understood that the invention encompasses other embodiments (not shown) wherein conditioning stone 24 is eliminated, and wherein steam is utilized as the sole cleaning source for reconditioning surface 18 of pad 14.

Pad 14 can be rubbed against a surface of conditioning stone 24 either during exposure of various portions of surface 18 to steam, prior to exposure of the surfaces of surface 18 to steam, or after exposure of various portions of surface 18 to steam. Preferably, surface 18 is exposed to conditioning stone 24 prior to exposure to steam to enable the steam to remove particulates from the surface that may have been left behind after the exposure of the surface to the reconditioning stone. In a most preferred embodiment of the present invention, the conditioning of surface 18 comprises reconditioning with both a stone and steam, and the reconditioning with the stone is completed prior to the last exposure of the surface to steam. By having the reconditioning with the stone completed prior to a final exposure to steam, the steam can be utilized to remove particulates that would otherwise be left behind after exposure to the abrasive stone surface. Such particulates can include abraded portions of pad 14, as well as particulates from the stone. In particular aspects of the invention, pad 14 can be removed from contact with stone 24 prior to a final exposure of the pad 14 to steam. The final exposure to steam can be the only exposure of the pad to steam, or alternatively can be in addition to previous exposures which had occurred prior to, or during, the period that the pad was in contact with the reconditioning stone.

FIG. 6 illustrates a front view of a portion of a second embodiment apparatus 70, and illustrates a second embodiment exemplary shape of a conditioning head. The conditioning head of FIG. 6 comprises conduits 72, 24 and 76 terminating in nozzles 78, 80 and 82, respectively. The nozzles can alternatively be referred to as outlet ports.

FIG. 6 illustrates steam exiting from the nozzles (downwardly extending arrows) and impacting surface 18 of pad 14. The steam exits the nozzles in overlapping fans 84, 86 and 88. The steam from the fans impacts a surface of conditioning pad 14 at angles from about 0° to about 45°, and the total spray angle of each fan can be from about 105° to about 145°. Suitable nozzles can be stainless steel nozzles capable of flow rate from 0.014 gallons per minute to 235 gallons per minute, and capable of spraying a flat fan spray pattern. The nozzles can direct the spray pattern directly at a surface of pad 14, and can tilt the spray pattern by, for example, about 75° relative to an inlet axis extending into the nozzles. The outlets of the nozzles can be circular, and can have diameters of from about 70 thousandths of an inch to about 110 thousandths of an inch.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for conditioning a surface of a polishing pad after chemical-mechanical polishing of a semiconductor substrate with the polishing pad surface, comprising:

providing an apparatus which includes a steam outlet port proximate a conditioning stone;

positioning the polishing pad with the polishing pad surface against the conditioning stone and displacing the polishing pad relative to the conditioning stone to rub the polishing pad surface with the conditioning stone; and flowing material through the steam outlet port and across the polishing pad surface as the polishing pad surface is rubbed with the conditioning stone; the material flowing through the steam outlet port containing steam, and an entirety of the material flowing through the steam outlet port in addition to said steam being in vapor phase.

2. The method of claim 1 wherein the steam is jetted onto the polishing pad surface to impact the polishing pad surface with a pressure of from about 10 psig to about 20 psig.

3. The method of claim 1 wherein the steam has a temperature of at least about 200° F. as it flows through the steam outlet port.

4. The method of claim 1 wherein the steam has a temperature of at least about 200° F. as it flows through the steam outlet port, and wherein the steam impacts the polishing pad surface with a pressure of from about 10 psig to about 20 psig.

5. The method of claim 1 wherein the material in addition to said steam contains ammonium.

6. The method of claim 1 wherein the material in addition to said steam contains ammonium citrate.

7. The method of claim 1 wherein the chemical-mechanical polishing utilizes the polishing pad to polish a copper-containing material; and wherein ammonium is within the steam during the exposure of the polishing pad surface to the steam.

8. The method of claim 1 further comprising:

removing the polishing pad surface from against the conditioning stone to complete the conditioning of the polishing pad surface with the conditioning stone; and after the conditioning of the polishing pad surface with the conditioning stone is completed, exposing the polishing pad surface to additional steam.

9. A method for chemical-mechanical polishing of a semiconductor substrate with a polishing pad surface and reconditioning the polishing pad surface, comprising:

providing a semiconductor substrate having a surface which is to be chemical-mechanical polished;

providing a polishing pad proximate the semiconductor substrate surface and utilizing a surface of the polishing pad to chemical-mechanical polish the semiconductor substrate surface;

providing an apparatus which includes a steam outlet port proximate a conditioning stone;

positioning the polishing pad with the polishing pad surface against the conditioning stone and displacing the polishing pad relative to the conditioning stone to rub the polishing pad surface with the conditioning stone; and flowing material through the steam outlet port and across the polishing pad surface as the polishing pad surface is rubbed with the conditioning stone; the material flowing through the steam outlet port containing steam, and an entirety of the material flowing through the steam outlet port being in vapor phase.

10. The method of claim 9 wherein the steam is jetted onto the polishing pad surface from a plurality of nozzles generating overlapping spray patterns of the steam.

11. The method of claim 9 wherein the steam is jetted onto the polishing pad surface from a plurality of nozzles generating overlapping spray patterns of the steam; and wherein the nozzle spray patterns are fans in which the steam impacts the polishing pad surface at angles of from 0° to 45 °.

12. The method of claim 9 wherein the steam is jetted onto the polishing pad surface from a plurality of nozzles.

13. The method of claim 9 wherein the steam is jetted onto the polishing pad surface to impact the surface with a pressure of from about 10 psig to about 20 psig.

14. The method of claim 9 wherein ammonium is within the steam during the exposure of the polishing pad surface to the steam.

15. The method of claim 9 wherein ammonium citrate is within the steam during the exposure of the polishing pad surface to the steam.

16. The method of claim 9 wherein the semiconductor substrate comprises a copper-containing material at the surface which is chemical-mechanical polished; and wherein ammonium is within the steam during the exposure of the polishing pad surface to the steam.

17. The method of claim 9 further comprising:

removing the polishing pad surface from against the conditioning stone to complete the conditioning of the polishing pad surface with the conditioning stone; and after the conditioning of the polishing pad surface with the conditioning stone is completed, exposing the polishing pad surface to additional steam.

* * * * *